US009115560B2

(12) United States Patent
Shaw

(10) Patent No.: US 9,115,560 B2
(45) Date of Patent: Aug. 25, 2015

(54) ANNULUS SEAL UTILIZING ENERGIZED DISCRETE SOFT INTERFACIAL SEALING ELEMENTS

(71) Applicant: Vetco Gray Inc., Houston, TX (US)

(72) Inventor: Michael Shaw, Aberdeenshire (GB)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 14/190,301

(22) Filed: Feb. 26, 2014

(65) Prior Publication Data

US 2014/0174764 A1 Jun. 26, 2014

Related U.S. Application Data

(63) Continuation-in-part of application No. 13/176,312, filed on Jul. 5, 2011.

(51) Int. Cl.
*E21B 33/03* (2006.01)
*E21B 33/04* (2006.01)

(52) U.S. Cl.
CPC ..... *E21B 33/03* (2013.01); *E21B 33/04* (2013.01)

(58) Field of Classification Search
USPC ..... 166/368, 378, 379, 88.1, 192, 180; 175/324; 277/308, 316, 328–329, 337, 277/530–531, 647, 626–627
See application file for complete search history.

(56) References Cited

U.S. PATENT DOCUMENTS

| | | | | |
|---|---|---|---|---|
| 5,044,672 | A * | 9/1991 | Skeels et al. | 285/98 |
| 5,685,369 | A * | 11/1997 | Ellis et al. | 166/195 |
| 7,513,483 | B1 * | 4/2009 | Blume | 251/332 |
| 2002/0140184 | A1 * | 10/2002 | Janoff et al. | 277/644 |
| 2010/0116489 | A1 * | 5/2010 | Nelson | 166/182 |
| 2010/0300705 | A1 | 12/2010 | Nelson | |

FOREIGN PATENT DOCUMENTS

| | | | |
|---|---|---|---|
| EP | 2357314 | A2 | 8/2011 |
| WO | 02077496 | A2 | 10/2002 |

OTHER PUBLICATIONS

GB Search Report dated Sep. 13, 2012 from corresponding Application No. GB1211908.7.

* cited by examiner

*Primary Examiner* — Cathleen Hutchins
*Assistant Examiner* — Taras P Bemko
(74) *Attorney, Agent, or Firm* — Bracewell & Giuliani LLP

(57) ABSTRACT

A seal assembly for sealing an annulus between inner and outer wellhead members includes an energizer ring formed of a high strength elastic material having inner and outer legs. An annular inner recess with grooves on its base is formed on an inward facing surface of the inner leg. An inner diameter seal ring formed of an inelastic material engages the grooves of the inner recess. An annular outer recess with grooves on its base is formed on an outward facing surface of the outer leg. An outer diameter seal ring formed of an inelastic material engages the grooves of the outer recess. When the energizer ring is coaxially inserted in the annulus, the inner diameter seal ring is compressively and permanently deformed into sealing contact with the inner wellhead member, and the outer diameter seal ring is compressively and permanently deformed into sealing contact with the outer wellhead member.

23 Claims, 8 Drawing Sheets

ANNULUS SEAL UTILIZING ENERGIZED DISCRETE SOFT INTERFACIAL SEALING ELEMENTS

CROSS REFERENCE TO RELATED APPLICATION

This application is a continuation-in-part of and claims priority to and the benefit of U.S. patent application Ser. No. 13/176,312, titled "Annulus Seal Utilizing Energized Discrete Soft Interfacial Sealing Elements," filed Jul. 5, 2011, the full disclosure of which is hereby incorporated herein by reference in its entirety for all purposes.

BACKGROUND OF THE DISCLOSURE

1. Field of the Disclosure

This disclosure relates in general to wellhead assemblies and in particular to seal assemblies for sealing between inner and outer wellhead members.

2. Description of the Related Art

Seals are used between inner and outer wellhead tubular members to contain internal well pressure. The inner wellhead member may be a casing hanger that supports a string of casing extending into the well for the flow of production fluid. The casing hanger lands in an outer wellhead member, which may be a wellhead housing, a Christmas tree, or a casing head. A packoff (or other seal assembly) seals the annulus between the casing hanger and the outer wellhead member. Alternately, the inner wellhead member can be a tubing hanger located in a wellhead housing and secured to a string of tubing extending into the well. A pack off (or other seal assembly) seals the annulus between the tubing hanger and the wellhead housing. In another alternative design, the inner wellhead member may be an isolation sleeve, such as might be used to isolate high pressure, abrasive fracturing fluids from certain portions of the wellhead. A packoff (or other seal assembly) seals the annulus between the isolation sleeve and the outer wellhead member.

A variety of annulus seals of this nature have been employed. Conventional annulus seals include, for example, elastomeric and partially metal and elastomeric rings. Prior art subsea stab type seals may utilize elastomeric materials which are compressed into an interference fit annulus. These are simple designs, easy to install, retain a reasonable constant load when unpressurised over time due to their inherent elasticity and are soft enough to flow and seal on minor defects. However such materials have a limited range of use in terms of temperature and fluid compatibility. They may swell and degrade mechanically in certain fluid environments, such as those found in many wellheads, and can suffer from explosive failure if subjected to rapidly decreasing pressure in a gas environment.

Prior art seal rings made entirely of metal for forming metal-to-metal seals are also employed. In order to cope with internal stressing remote from the interfaces, metal seals of the prior art are made from hard high strength materials which make sealing at the interface difficult and require generating of huge loads to provide any degree of damage tolerance. This in turn will itself cause damage to the same surfaces. To overcome this, coatings in the form of spray coatings or plating or melted inlays, such as brazing, have been used to bond a secondary softer material to the metal seal. These coatings are often difficult to apply, costly, inefficient in material usage, tend to increase the hardness of the sprayed material and are typically difficult to apply thick enough to provide the volume of material required to seal on serious defects.

A third option for the prior art has been to use inelastic thermoplastic materials such as polytetrafluoroethylene, or molded graphite for the sealing apparatus. These do not have any inherent elasticity and so require some secondary parts, such as internal springs, to provide an elastic response to the changing environment that ensures the seal retains a reasonable constant load when unpressurised over time and so ensuring a seal is maintained at all times. Due to the low strength of thermoplastic materials they generally cannot sustain the loads required to cause significant plastic flow at the interface and so do not tend to seal well on damaged surfaces.

Therefore while metal or inelastic materials allow a much wider temperature range, do not swell or degrade mechanically in most fluid environments and do not suffer from explosive gas decompression, they do represent many other technical problems, most notably an inability to seal on damaged surfaces. Damage to subsea parts cannot be fully monitored or controlled and therefore seal failure due to damaged surfaces represents a significant cost risk when running equipment subsea.

SUMMARY OF THE DISCLOSURE

There is a need for an annulus seal that would maintain a seal on serious surface defects, operate over a much wider temperature range, does not swell or degrade mechanically in most fluid environments, does not suffer from explosive gas decompression and can be easily and cheaply manufactured. In view of the foregoing, various embodiments of the present disclosure advantageously provide seal assemblies to address shortfalls of the prior art. Various embodiments of the present application use soft inelastic materials in a situation where the seal is highly loaded, by removing the inelastic material from the highly stressed unsupported areas and replacing it with a high strength energizer. Alternative embodiments use thick soft metallic materials, in fully annealed condition if required, with no need for a metallurgical or other type of bond to the base component.

More specifically, the current disclosure provides a seal assembly for sealing an annulus between inner and outer wellhead members. The seal assembly includes an energizer ring formed of a high strength elastic material having inner and outer legs and a central axis. An annular inner recess is formed on an inward facing surface of the inner leg, the inner recess having grooves on a base the inner recess. An inner diameter seal ring is formed of an inelastic material, the inner diameter seal ring engaging the grooves of the inner recess. An annular outer recess is formed on an outward facing surface of the outer leg, the outer recess having grooves on a base of the outer recess. An outer diameter seal ring is formed of an inelastic material located in the outer recess, the outer diameter seal ring engaging the grooves of the outer recess. Wen the energizer ring is coaxially inserted in the annulus, the inner diameter seal ring is compressively and permanently deformed into sealing contact with the inner wellhead member, and the outer diameter seal ring is compressively and permanently deformed into sealing contact with the outer wellhead member.

In other embodiments of the current disclosure a wellhead assembly includes an outer wellhead member having a bore and an axis. An inner wellhead member is located in the bore defining an annulus between the inner and outer wellhead members. An energizer ring is formed of an elastic material and has a base and inner and outer legs, each leg extending axially from the base to a free end that biases in opposing radial directions respectively against the inner and outer wellhead members. There is an open slot between the legs. The inner leg has an inward facing surface with an annular inner band located on and protruding inward from the inward facing surface of the inner leg. An annular inner recess is formed in the inner band, the inner annular recesses having grooves on a base of the inner recess. An annular inner diameter seal ring is formed of an inelastic material and located in the inner recess and engages the grooves of the inner recess. The outer leg has an outward facing surface with an annular outer band located on and protruding outward from the outward facing surface of the outer leg. An annular outer recess is formed in the outer band, the outer annular recesses having grooves on a base of the outer recess. An annular outer diameter seal ring is formed of an inelastic material and located in the outer recess. The outer diameter seal ring engages the grooves of the outer recess.

Yet other embodiments of the current disclosure prove a method for sealing an annulus between inner and outer wellhead members. The method involves providing a seal assembly that includes an energizer ring formed of a high strength elastic material having inner and outer legs and a central axis, an annular inner recess formed on an inward facing surface of the inner leg having grooves on a base of the inner recess, an inner diameter seal ring formed of an inelastic material engaging the grooves of the inner recess, an annular outer recess formed on an outward facing surface of the outer leg having grooves on a base of the outer recess, and an outer diameter seal ring formed of an inelastic engaging the grooves of the outer recess. The method also includes inserting the seal assembly into the annulus so that the seal rings contact inner and outer surfaces of the annulus, plastically deforming the seal rings into sealing engagement between the legs and the inner and outer surfaces by a spring force in the legs.

BRIEF DESCRIPTION OF THE DRAWINGS

So that the manner in which the features and advantages of the disclosure, as well as others which will become apparent, may be understood in more detail, a more particular description of the disclosure briefly summarized above may be had by reference to the embodiments thereof which are illustrated in the appended drawings, which form a part of this specification. It is to be noted, however, that the drawings illustrate only various embodiments of the disclosure and are therefore not to be considered limiting of the disclosure's scope as it may include other effective embodiments as well.

DETAILED DESCRIPTION

The present disclosure will now be described more fully hereinafter with reference to the accompanying drawings, which illustrate embodiments of the disclosure. Embodiments of this disclosure may, however, be in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout. Prime notation, if used, indicates similar elements in alternative embodiments.

Figure 1:
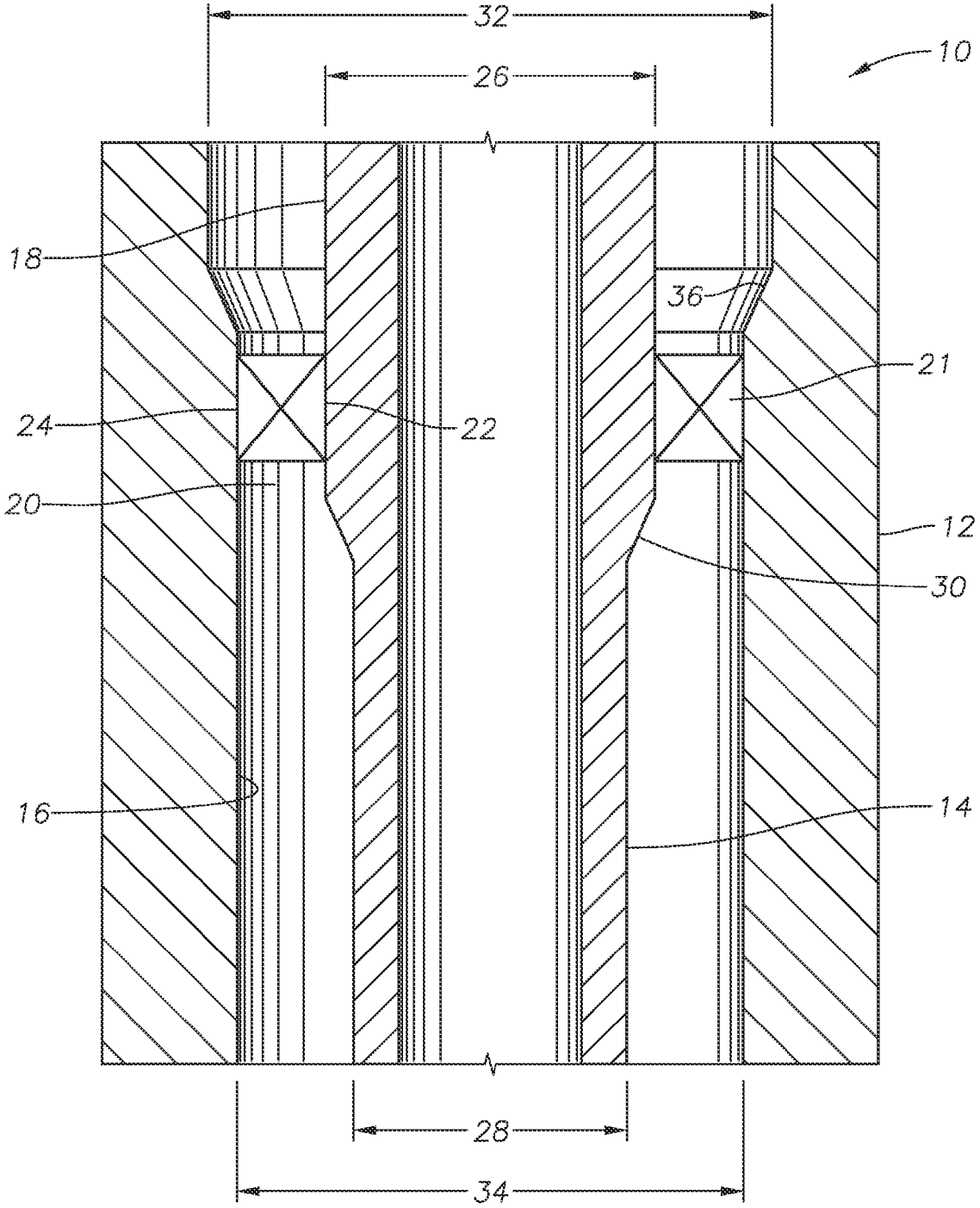
FIG. 1 is a sectional view of portions of a wellhead assembly providing a annulus seal.

FIG. 1 illustrates, for example, portions of a wellhead assembly 10 including a seal assembly 21, which may be a seal assembly according to any of the embodiment of the present application. The wellhead assembly 10 can include an outer wellhead member or tubular 12 affixed at an upper end of a wellbore (not shown) and coaxially circumscribing an inner wellhead member or tubular 14. The outer tubular 12 may be, for example, a high-pressure wellhead housing or a casing hanger. The inner tubular 14 may be, for example, a casing hanger, casing, tubing hanger, production tubing, or an isolation sleeve.

Inner tubular 14 transitions from an upper region with a larger outer diameter 26 higher within the wellhead assembly 10, to a lower region with a smaller outer diameter 28 lower within the wellhead assembly 10 through a downward facing shoulder 30. Outer tubular 12 transitions from an upper region with a larger inner diameter 32 higher within the wellhead assembly to a lower region with a smaller inner diameter 34 lower within the wellhead assembly 10 through an upward facing shoulder 36.

The spaced apart distance between the respective inner surface 16 of outer tubular 12 and outer diameter surface 18 of the inner tubular 14, respectively form an annulus 20. Within annulus 20 is seal assembly 21. Seal assembly 21 is ring shaped. The diameter of the opening in the center of the ring shaped assembly 21 is sized so that inner diameter sealing surface 22 of seal assembly 21 makes contact with the outer diameter surface 18 of the inner tubular 14. The outer diameter of the ring shaped assembly 21 is sized so that outer diameter sealing surface 24 of seal assembly 21 makes contact with inner surface 16 of outer tubular 12. Embodiments of seal assembly 21 are shown in FIGS. 2-6.

Turning to FIGS. 2A-2C and 3, the seal assembly 21 may comprise an energizer 38. Energizer 38 is a ring shaped member with a central axis 37. Energizer 38 is shown as having a single "U" cross sectional shape, creating a downward or upward facing (as applicable) internal slot or groove 39. Internal groove 39 results in energizer 38 having an outer leg 41 and an inner leg 43, defined by the shape of internal groove 39. Each of the legs 41, 43 has a base end proximate to the closed end of internal groove 39 and a free end opposite its base end. Each of the legs 41, 43 has an exterior surface that faces away from the other leg and an interior surface that faces towards the other leg. Although the legs 41, 43 in the figures of this disclosure have been identified as being either an outer leg 41 or an inner leg 43, in other embodiments, the shape and position of the legs may be reversed. Although the energizer 38 is shown in FIGS. 2A-2C and 3 as a upward facing "U" shape, the orientation of the "U" shape may be reversed in alternative embodiments.

Figure 2A:
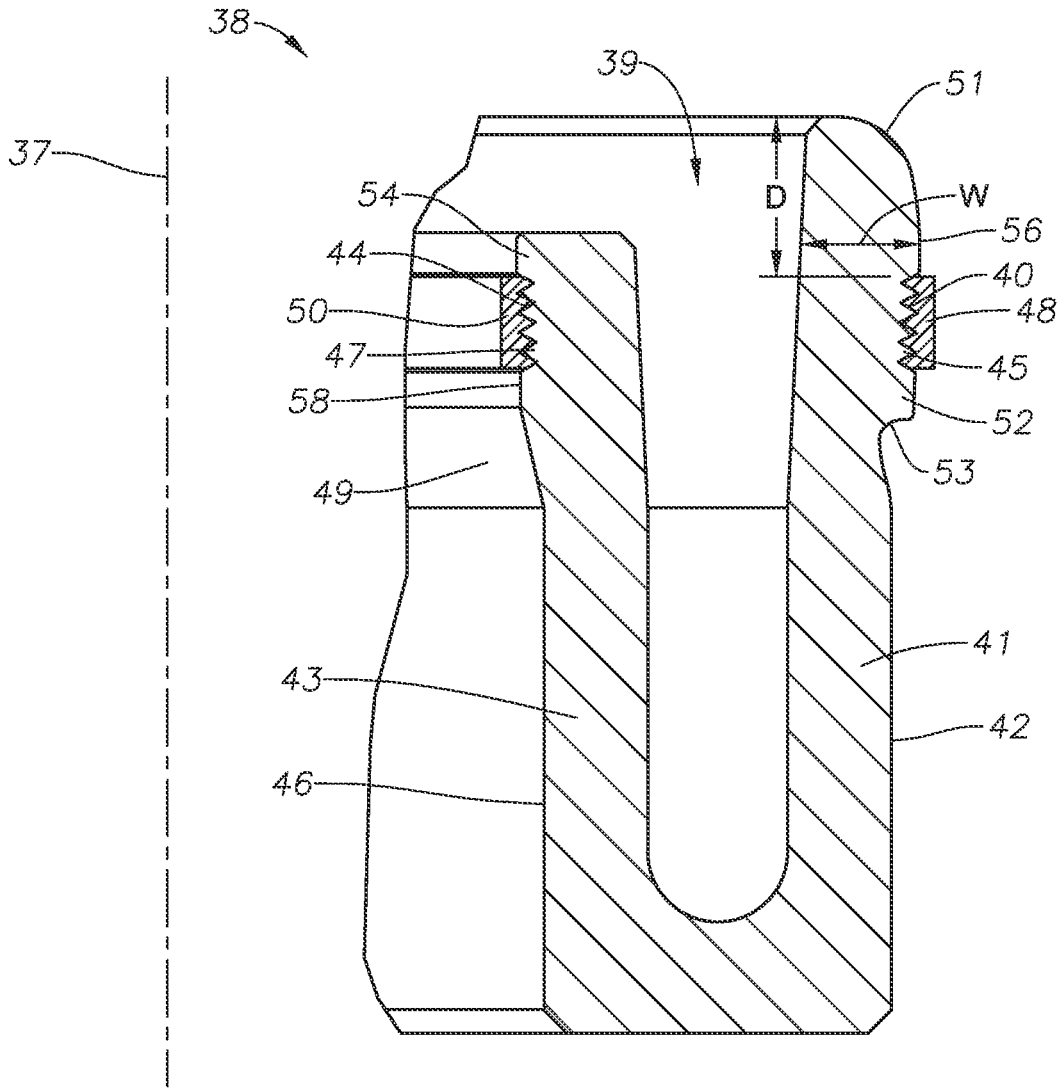
FIG. 2A is a sectional view of a portion of a seal assembly according to an embodiment of the present disclosure.
Figure 2B:
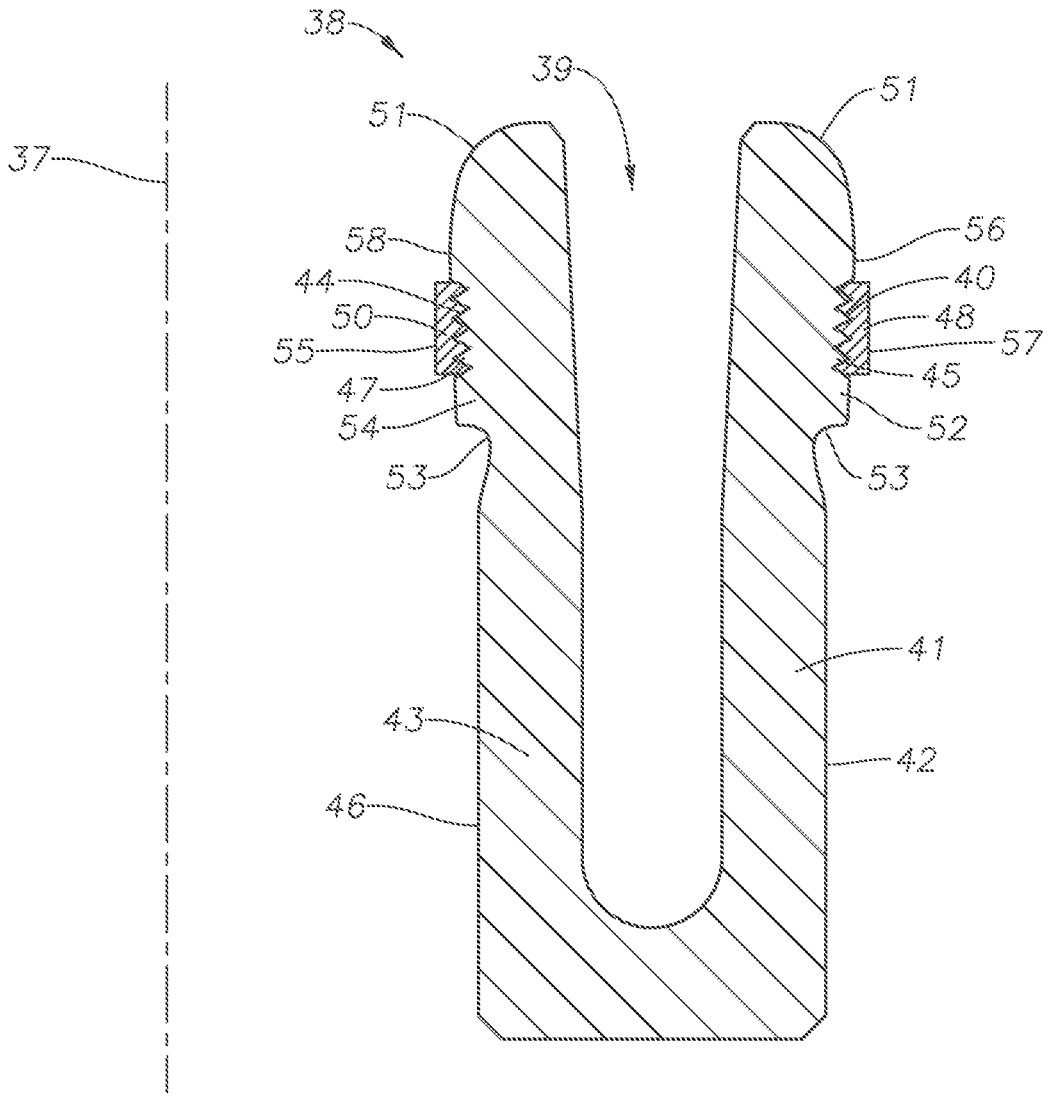
FIG. 2B is a sectional view of a portion of the seal assembly according to an alternative embodiment of the present disclosure.
Figure 3:
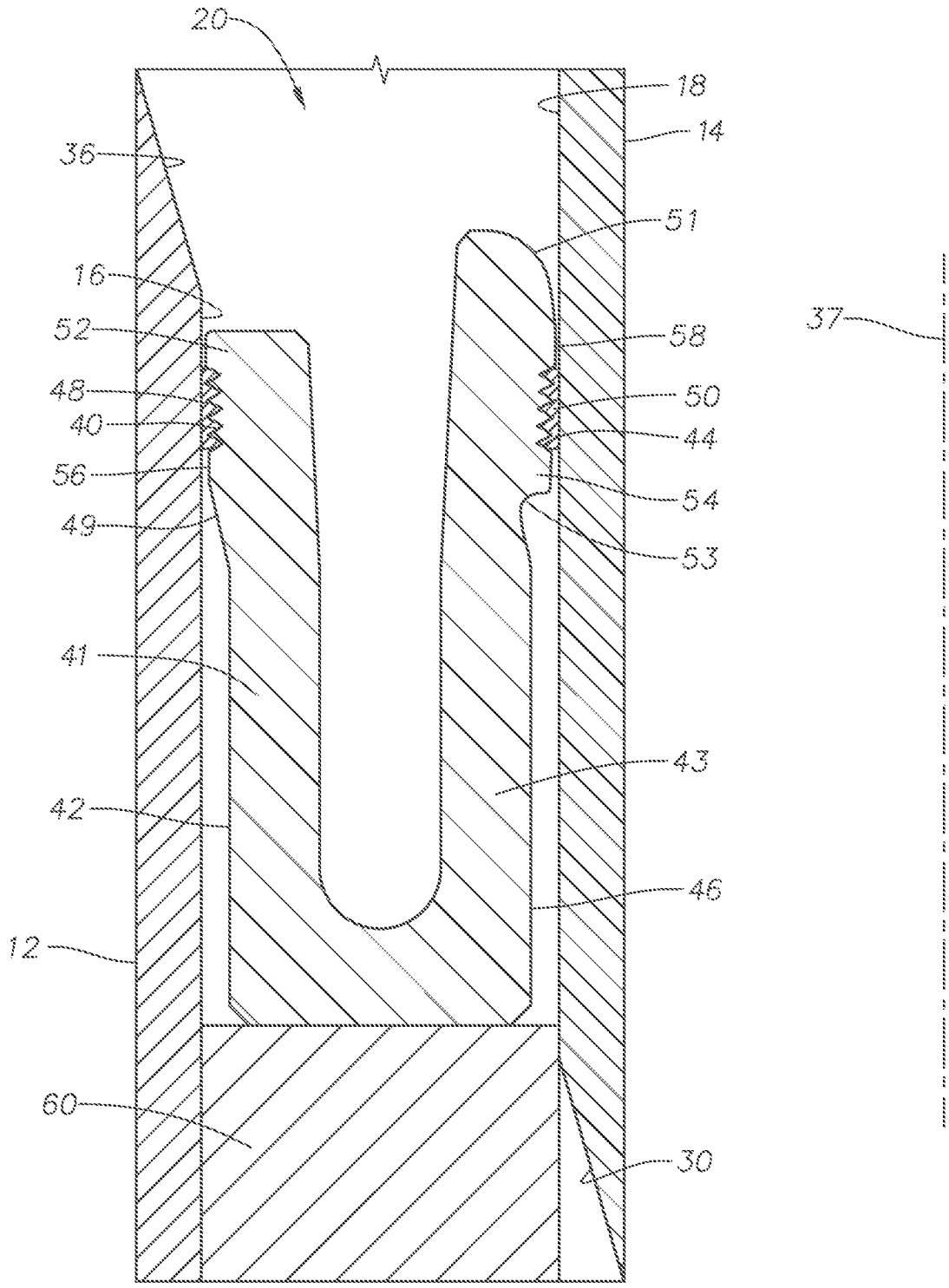
FIG. 3 is a sectional view of the seal assembly of FIG. 2A located within a wellhead assembly.

Energizer 38 has an annular outer circumferential recess 40 on the outer surface 42 of energizer 38 and an annular inner circumferential recess 44 on the inner surface 46 of energizer 38. Outer recess 40 contains an outer diameter seal ring 48 and inner recess 44 contains an inner diameter seal ring 50. In the embodiments of FIGS. 2A-2B and 3, outer recess 40 has grooves 45 formed on an outward facing base of the outer recess 40 and inner recess 44 has grooves 47 formed on an inward facing base of the inner recess 44. Outer diameter seal ring 48 engages the grooves 45 of the outer recess 40 to assist in maintaining the position of outer diameter seal ring 48 within outer recess 40 during installation of the seal assembly 21 into the wellhead assembly 10. Similarly, the inner diameter seal ring 50 engages the grooves 47 of the inner recess 44 to assist in maintaining the position of inner diameter seal ring 48 during installation of the seal assembly 21 into the wellhead assembly 10.

Each of the legs 41, 43 has an enlarged portion proximate to the free end. The enlarged portion has a radial width greater than the radial with of the leg 41, 43 proximate to the base end. Outer recess 40 and inner recess 44 are formed in the enlarged portion of legs 41, 43, respectively. The enlarged portions define circumferential bands or protrusions 52 that project outward from outer surface 42 of energizer 38 above and below outer circumferential recess 40. Similarly, the enlarged portions define circumferential bands or protrusions 54 that project inward from inner surface 46 of energizer 38 above and below inner circumferential recess 44. Protrusions 52, 54 have circumferential end surfaces 56, 58, respectively. At least an axial length of end surfaces 56, 58 are cylindrical surfaces that are concentric with axis 37. Annular recesses 40, 44 are located within each of the bands 52, 54 respectively. In certain embodiment, annular recesses 40, 44 are positioned so that for at least one of the legs 41, 43, the largest radial width W of the leg 41, 43 is less than the axial distance D between the free end of the leg 41, 43 and the recess 40, 44 (FIG. 2A).

In the embodiment of FIGS. 2A-2B and 3, the interior surface of each of the legs 41, 43 can include two separately oriented surfaces. Proximate the base end of each of the legs 41, 43, the interior surface of each of the inner and outer legs 41, 43 is a cylindrical surface that is coaxial with axis 37. Proximate to the free end of each of the legs 41, 43, the interior surface of each of the inner and outer legs 41, 43 is conical, having a larger diameter proximate to the free end of legs 41, 43 when the energizer 38 is in a relaxed position. In other embodiments, such as that of FIG. 2C, the interior surface of each of the inner and outer legs 41, 43 can be a single annular surface that is coaxial with axis 37.

As shown in the embodiments of FIGS. 2A and 3, inner leg 43 is a longer leg and outer leg 43-41 is a shorter leg such that the inner leg 43 has a axial length that is greater than the axial length of outer leg 41. The exterior surface of outer leg 41 tapers gradually where the radial width of the outer leg 41 increases to the enlarged portion of bands 52, defining a conical exterior surface 49 of the outer leg 41. This conical exterior surface 49 can act as a lead in surface to slidingly engage the outer tubular 12 when the seal assembly 21 is installed in the wellhead assembly 10.

The exterior surface of inner leg 43 has a large radius of curvature 51 extending from the free end towards the inner recess 44. The large radius of curvature 51 can be a continuous curving surface made up of a series of surfaces with different radii. At least one surface of radius of curvature 51 has a radius with a length that is greater than the radial width of inner leg 43, such that the center point of such surface is outside of the outer inner leg 43. The large radius of curvature 51 can act as a lead in surface to slidingly engage the inner tubular 14 when the seal assembly 21 is installed in the wellhead assembly 10. In such embodiments, the seal assembly 21 is slidingly engaged in one direction by the outer tubular 12 and is slidingly engaged in an opposite directly by the inner tubular 14. The exterior surface of inner leg 43 has a undercut recess 53 located adjacent to the enlarged portion, where the bands 54 meet the inner surface 46. The undercut recess 53 can provide stress relief when the seal assembly 21 is installed in the wellhead assembly 10.

In other embodiments, the inner and outer legs 41, 43 can be of substantially equal length and have large radii of curvature 51 on both the inner and outer legs 41, 43, for slidingly engaging both the inner and outer tubulars 12, 14 in the same direction when the seal assembly 21 is inserted in the wellhead assembly 10 (FIG. 2B). In other embodiments the inner and outer legs 41, 43 can be of substantially equal length and both have conical exterior surfaces 49 for slidingly engaging both the inner and outer tubulars 12, 14 in the same direction when the seal assembly 21 is inserted in the wellhead assembly 10 (not shown).

Figure 2C:
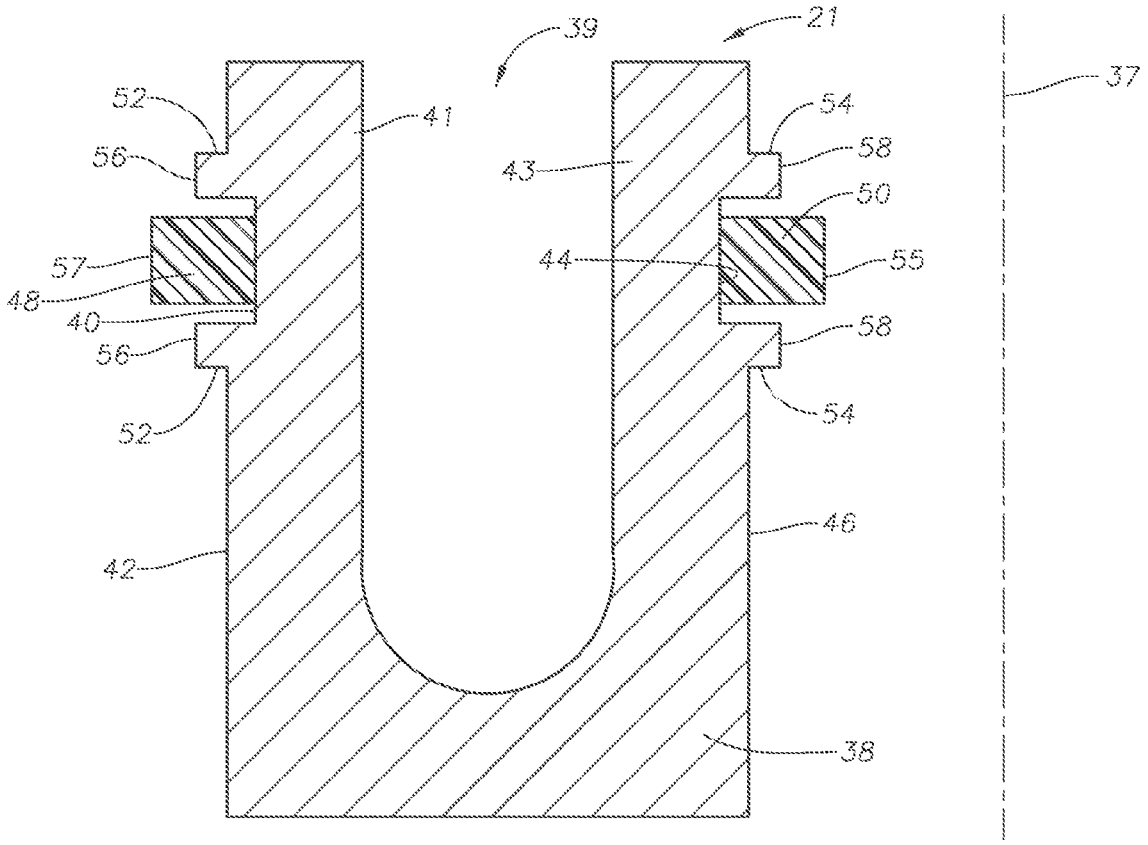
FIG. 2C is a sectional view of a portion of the seal assembly according to an alternative embodiment of the present disclosure.

Seal rings 48, 50 are shown with a generally rectangular cross section with a grooved surface that engages the grooves 45, 47 of annular recess 40, 44 (FIGS. 2A-2B and 3) or as solid square in cross section (FIG. 2C) but they may have other alternative cross sections, such as rectangular, semicircular, circular, oval, or other workable shape. Seal rings 48, 50 may be molded in place, extruded, machined complete, compression formed from wire and joined at the ends or fabricated by other known methods. In the embodiment of FIG. 2C, when energizer 38 is not positioned within annulus 20, the axial height of outer circumferential recess 40 is bigger than the axial height of outer diameter seal ring 48 and the axial height of inner circumferential recess 44 is bigger than the axial height of inner diameter seal ring 50. This allows room for seal rings 48, 50 to expand in height when the width of the seal rings 48, 50 is compressed, as shown in FIG. 3, when seal assembly 21 is located within annulus 20. Seal rings 48, 50 are not fixed or bonded to energizer 38. This avoids a complicated or costly bonding process, allows for easy replacement of the seal rings 48, 50, and allows the seal rings 48, 50 to more readily flow into defects.

As show in FIG. 3, when energizer 38, is located within annulus 20, outer seal ring 48 is in sealing engagement with inner surface 16 of outer tubular 12 and the energizer 38. Inner seal ring 50 is in sealing engagement with outer diameter surface 18 of the inner tubular 14 and energizer 38. Energizer 38 is positioned above downward facing shoulder 30 of inner tubular 14 and below upward facing shoulder 36 of outer tubular 12. In alternative embodiments, shoulder 30 may be upward facing and shoulder 36 may be downward facing. In yet other alternative embodiments, shoulders 30, 36 may both face upwards or both face downwards. Internal groove 39 of energizer 38 is open to the pressure of the well fluid contained within annulus 20. In the embodiment of FIG. 3, the pressure side is at the higher end of annulus 20 and therefore internal groove 39 opens upward. In alternative embodiment, the pressure side may be at the lower end of annulus 20, in which case, the groove 39 would open downward. A retainer ring 60 is located below energizer 38 to limit downward movement of energizer 38 within annulus 20.

Seal assembly 21 may be installed within annulus 20 with an interference between the inner surface 16 of outer tubular 12 and outer diameter surface 18 of the inner tubular 14. In this case, the initial radial dimension of the energizer 38, measured from end surface 56 to end surface 58 is larger than the distance between inner surface 16 of outer tubular 12 and the energizer 38, outer diameter surface 18 of the inner tubular 14. Similarly, the initial radial dimension from inner surface 55 of the inner diameter seal ring 50 to an outer surface 57 of the outer diameter seal ring 48 greater than a radial width of the annulus between inner surface 16 of outer tubular 12 and the outer diameter surface 18 of the inner tubular 14. Therefore legs 41, 43 of energizer 38 will have to deflect inward towards each other when inserted within annulus 20.

This inward deflection of legs 41, 43 of energizer 38 generate an outward radial elastic load. This will cause seal rings 48, 50 to be compressed between inner surface 16 of outer tubular 12 and the energizer 38, and the outer diameter surface 18 of the inner tubular 14 and energizer 38, respectively.

The compressive forces causes plastic or permanent deformation of seal rings 48, 50, causing them to fill the recesses 40 and 44 and to seal with and fill any defects in outer tubular 12 and inner tubular 14. The deformation of seal rings 48, 50 is contained to the interior of recesses 40, 44, which act as anti-extrusion means. End surfaces 56, 58 of protrusions 52 and 54 will become proximate to, and may contact, the inner surface 16 of outer tubular 12 and outer diameter surface 18 of the inner tubular 14, respectively, to limit the outward radial forces on seal rings 48, 50. The combination of the elastic deformation of energizer 38 and plastic deformation of seal rings 48, 50 creates a constant elastic contact pressure at each of the sealing interfaces which does not diminish with time or load history or temperature, and creates a seal at low pressure and also possibly at high pressure.

Alternatively, radial outward elastic load of energizer 38 may be created by the fluid pressure within annulus 20. In this embodiment, the fluid pressure within annulus 20 and groove 39 will act on the inside surfaces of groove 39, which is open to the pressure of the fluid contained within annulus 20, applying a radial force on legs 41, 43. In the same manner as discussed above, this will cause seal rings 48, 50 to be compressed between inner surface 16 of outer tubular 12 and the energizer 38, and the outer diameter surface 18 of the inner tubular 14 and energizer 38, respectively. As described above, the compression causes plastic or permanent deformation of seal rings 48, 50, causing them to fill the recesses 40 and 44. In this case, a drop in pressure may cause a drop in elastic loading of the energizer 38. Another alternative embodiment is to combine both an interference fit and fluid pressure loading on energizer 38. In this embodiment, the energizer 38 and seal rings 48, 50 will still maintain a seal in the event of a complete loss of fluid pressure, but the elastic forces of energizer 38 may be augmented by fluid pressure within annulus 20 and groove 39.

Seal rings 48, 50 are formed of soft inelastic materials and may be for example, a soft metal such as lead, tin, silver or alloys of these metals. Selection of the material to use will depend on the operating pressure to which the seal assembly 21 will be exposed and setting load required to push fit the seal. In alternative embodiments, other soft metals such as gold or tantalum can be used or the seal rings 48, 50 could be formed of an inelastic thermoplastic, such as virgin polytetrafluoroethylene, filled polytetrafluoroethylene or polyetheretherketone, or other inert inelastic materials such as compression molded graphite. Seal rings 48, 50 may alternatively be formed of other soft inelastic materials. An appropriate soft inelastic material will be selected so that seal rings 48, 50 will flow readily into defects on the inner surface 16 of outer tubular 12 and the outer diameter surface 18 of the inner tubular 14 and create sufficient contact pressure on the surface of any such defect to create a seal when subjected to radial loading. Where there is no defect present the seal rings 48, 50 will simply deform and flow upwards and downwards in the recesses 40, 44 to fill the available space, while creating a seal on the defect free inner surface 16 of outer tubular 12 and the outer diameter surface 18 of the inner tubular 14.

Energizer 38 is formed from material that is strong enough to withstand the internal fluid pressure within the annulus 20 as well as any internal loads generated by the interference fit between the energizer 38, the inner surface 16 of outer tubular 12 and outer diameter surface 18 of the inner tubular 14, without undergoing significant plastic deformation, which could limit the load that could be applied to energizer 38 or cause failure of energizer 38 and thus cause the seal assembly 21 to fail. Energizer 38 must therefore be made from material with higher strength or that is harder than the material used to make the seal rings 48, 50. Preferably, energizer 38 is made from a nickel based alloy or other corrosion resistant alloy. Where corrosion is not of concern, energizer 38 can be made from carbon steel.

Figure 4:
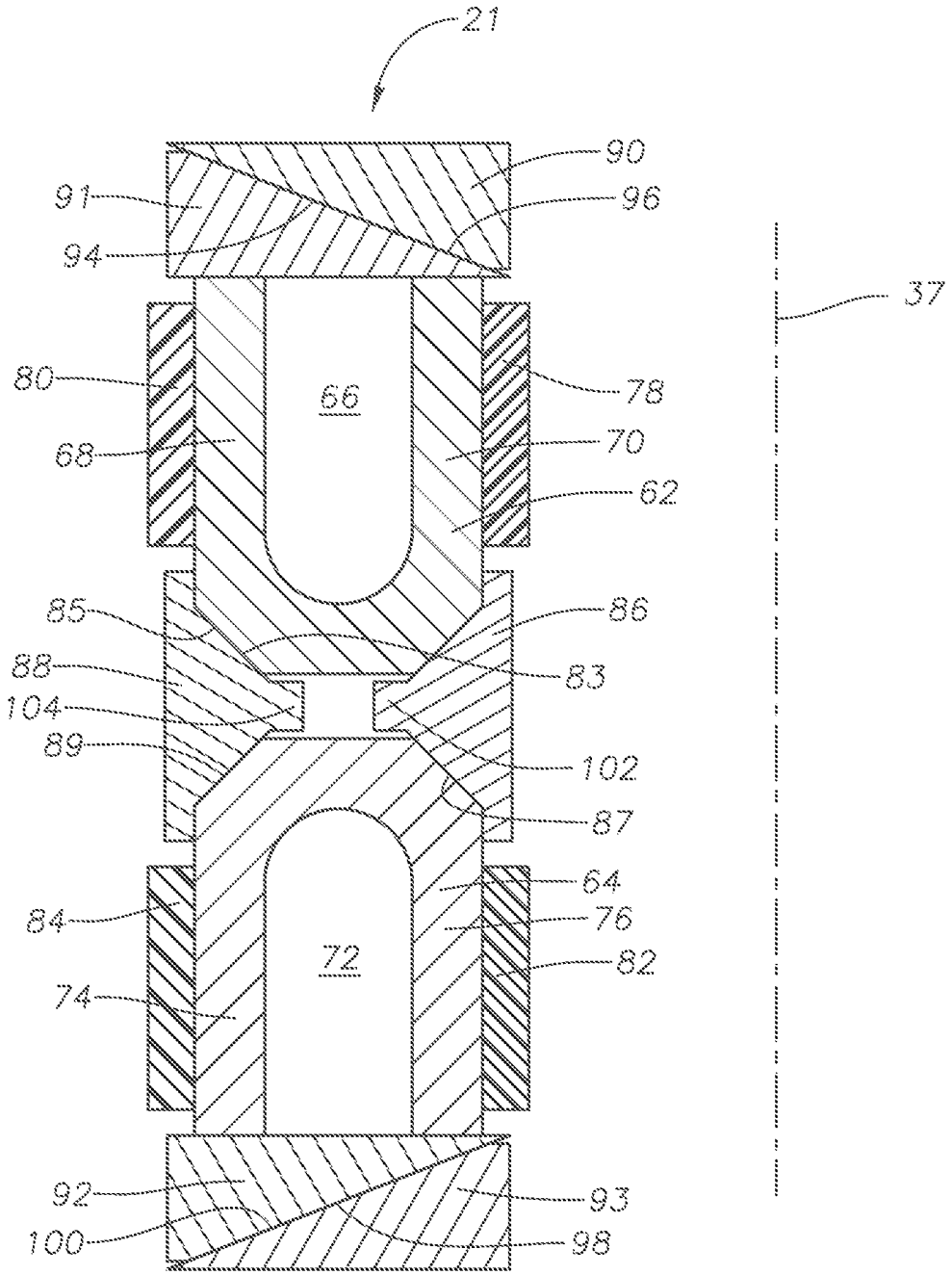
FIG. 4 is a sectional view of a portion of a seal assembly according to an alternative embodiment of the present disclosure.

In an alternative embodiment, as shown in FIG. 4, the seal assembly may comprise two energizers, including a primary energizer 62 and a backside energizer 64. Energizers 62, 64 are shown as single "U" section shaped rings. Primary energizer 62 has an upward facing internal slot or groove 66, which results in energizer 62 having an outer leg 68 and an inner leg 70, defined by the shape of internal groove 66. Backside energizer 64 has a downward facing internal slot or groove 72, which results in energizer 64 having an outer leg 74 and an inner leg 76, defined by the shape of internal groove 72. Energizers 62, 64 may have alternative shaped cross sections.

Primary inner diameter seal ring 78 is located external to leg 70 of primary energizer 62 and primary outer diameter seal ring 80 is located external to leg 68 of primary energizer 62. Backside inner diameter seal ring 82 is located external to leg 76 of backside energizer 64 and backside outer diameter seal ring 84 is located external to leg 74 of backside energizer 64. Seal rings 78, 80, 82, 84 are shown with a solid rectangular cross section but they may have other alternative cross sections, such as square, semi-circular, circular, oval, or other workable shape. Seal rings 78, 80, 82, 84 may be extruded, machined complete, compression formed from wire and joined at the ends or fabricated by other known methods.

An inner intermediate anti-extrusion ring 86 is located below primary inner diameter seal ring 78 and above backside inner diameter seal ring 82. A lateral portion 102 of inner intermediate anti-extrusion ring 86 extends between primary energizer 62 and backside energizer 64. An outer intermediate anti-extrusion ring 88 is located below primary outer diameter seal ring 80 and above backside outer diameter seal ring 84. A lateral portion 104 of outer intermediate anti-extrusion ring 88 extends between primary energizer 62 and backside energizer 64.

In the embodiment of FIG. 4, intermediate anti-extrusion rings 86, 88 are generally wedge shaped with upward facing shoulders 83 which engage downward facing wedge surfaces or shoulders 85 of primary energizer 62. Downward facing wedge surface or shoulder 87 of anti-extrusion rings 86, 88 engage upward facing shoulders 89 of backside energizer 64.

Primary anti-extrusion rings 90, 91 are located above primary seal rings 78, 80 and backside anti-extrusion rings 92, 93 are located below backside seal rings 82, 84. In the embodiment of FIG. 4, the primary anti-extrusion rings 90, 91 consist of a pair of rings with a wedge shaped cross section. Outer primary anti-extrusion ring 90 has an upper surface which is essentially horizontal and an angled downward facing surface 94. Inner primary anti-extrusion ring 91 has a lower surface which is essentially horizontal and an angled upward facing surface 96. Downward facing surface 94 of outer primary anti-extrusion ring 90 engages upward facing surface 96 of Inner primary anti-extrusion ring 91. Inner backside anti-extrusion ring 92 has an upper surface which is essentially horizontal and an angled downward facing surface 98. Outer primary anti-extrusion ring 93 has a lower surface which is essentially horizontal and an angled upward facing surface 100. Downward facing surface 98 of inner backside anti-extrusion ring 92 engages upward facing surface 100 of outer backside anti-extrusion ring 93.

Figure 5:
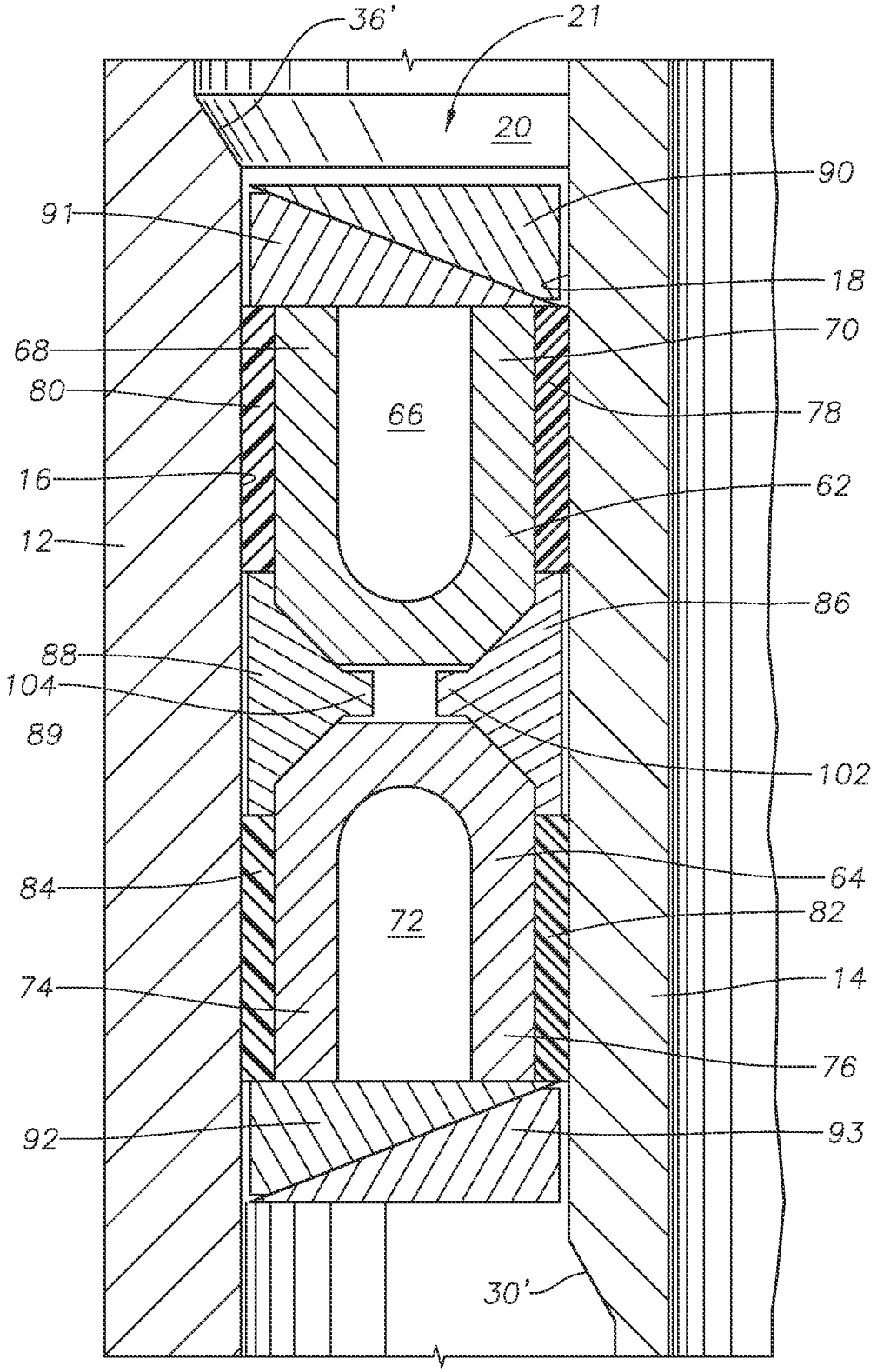
FIG. 5 is a sectional view of the seal assembly of FIG. 4 located within a wellhead assembly.

Before being inserted in an annulus, the inner diameter of the inner diameter seal rings 78, 82 is smaller than the inner diameter of the primary anti-extrusion rings 90, 91 intermediate inner anti-extrusion ring 86, and backside anti-extrusion rings 92, 93. Similarly, the outer diameter of the outer diameter seal rings 80, 84 is larger than the outer diameter of primary anti-extrusion rings 90, 91 intermediate outer anti-extrusion ring 88, and backside anti-extrusion rings 92, 93. In addition, the height of the seal rings 78, 80 is shorter than the distance between the primary anti-extrusion rings 90, 91 and the intermediate anti-extrusion rings 86, 88. The height of the seal rings 82,84 is shorter than the distance between the intermediate anti-extrusion rings 86, 88, and the backside anti-extrusion rings 92, 93. This allows room for seal rings 78, 80, 82, 84 to expand in height when the width of the seal rings 78, 80, 82, 84 is compressed, as shown in FIG. 5, when seal assembly 21 is located within annulus 20. Seal rings 78, 80, 82, 84 are not fixed or bonded to energizers 62, 64. This avoids a complicated or costly bonding process, allows for easy replacement of the seal rings 78, 80, 82, 84, and allows the seal rings 78, 80, 82, 84 to more readily flow into defects.

When seal assembly 21 of FIG. 5 is positioned within an annulus 20, primary outer diameter seal ring 80, is in sealing engagement with inner surface 16 of outer tubular 12 and with the primary energizer 62. Primary inner diameter seal ring 78 is in sealing engagement with outer diameter surface 18 of the inner tubular 14 and with primary energizer 62. Backside outer diameter seal ring 84, is in sealing engagement with inner surface 16 of outer tubular 12 and with the backside energizer 64. Backside inner diameter seal ring 82 is in sealing engagement with outer diameter surface 18 of the inner tubular 14 and with backside energizer 64. Seal assembly 21 is positioned above downward facing shoulder 30' of inner tubular 14 and below upward facing shoulder 36' of outer tubular 12.

Figure 6:
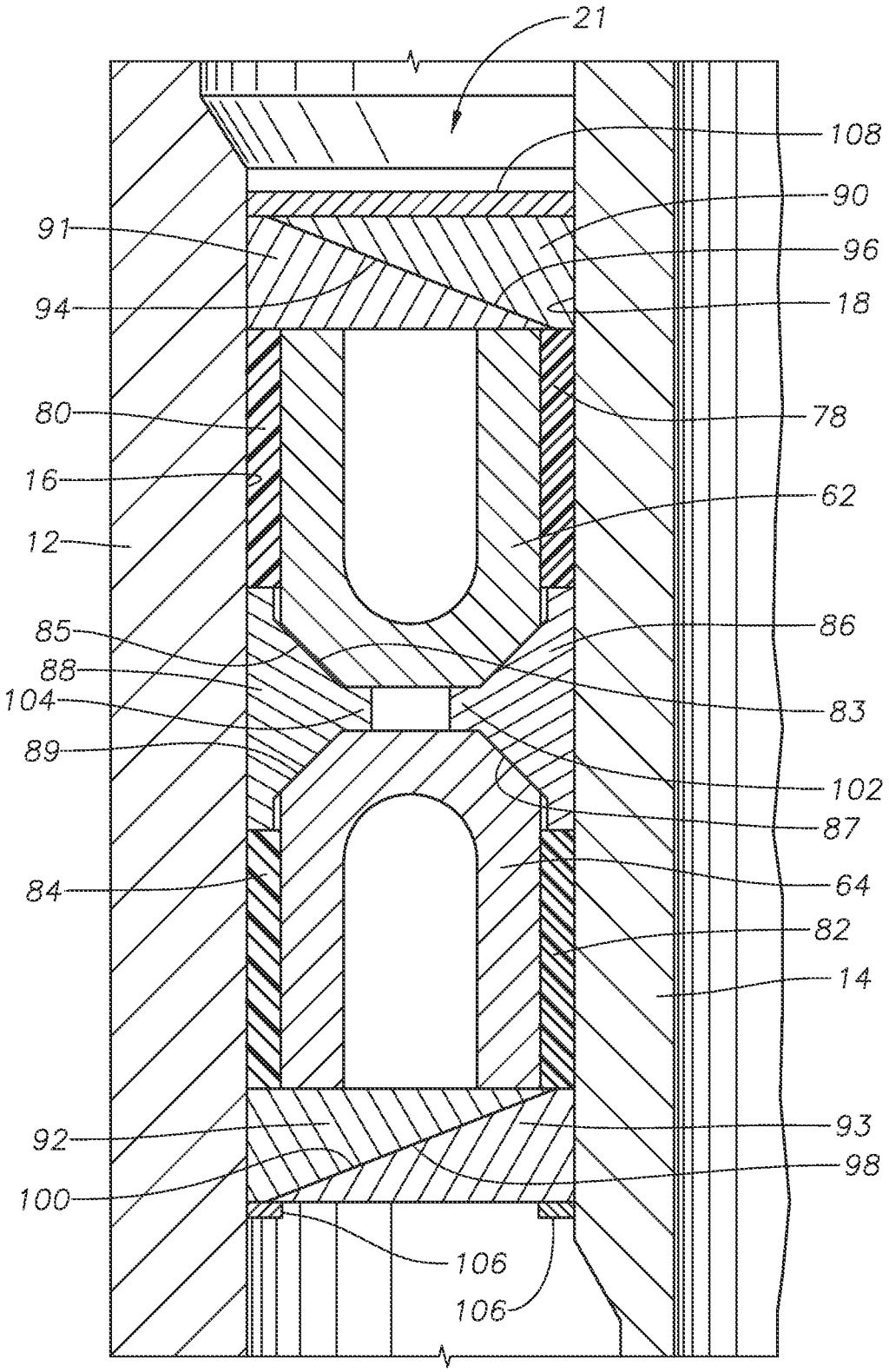
FIG. 6 is an additional sectional view of the seal assembly of FIG. 4 located within a wellhead assembly.

As shown in FIG. 6, when seal assembly 21 is fully set within annulus 20, backside anti-extrusion rings 92, 93 will be restrained from further downward movement. For example, backside anti-extrusion rings 92, 93 may land on shoulders 106 on the inner surface 16 of outer tubular 12 and outer diameter surface 18 of the inner tubular 14. In alternative embodiments, a retainer ring or similar devise may be used instead.

By continuing to apply a downwards force to primary anti-extrusion rings 90, 91, downward facing surface 98 of inner backside anti-extrusion ring 92 engages and slides along upward facing surface 100 of outer backside anti-extrusion ring 93. This causes the inner backside anti-extrusion ring 92 to move towards and come into contact with inner surface 16 of outer tubular 12 and outer backside anti-extrusion ring 93 to move towards and come into contact with outer diameter surface 18 of the inner tubular 14. Backside anti-extrusion rings 92, 93 will together then cover the full diameter of annulus 20, limiting the downward expansion of backside seal rings 82, 84.

This downward force on primary anti-extrusion rings 90, 91 will cause primary energizer 62 to move towards backside energizer 64. This causes upward facing shoulders 83 of intermediate anti-extrusion ring to engage downward facing shoulders 85 of primary energizer 62, and downward facing shoulder 87 of anti-extrusion rings 86, 88 engage upward facing shoulders 89 of backside energizer 64, forcing the intermediate outer anti-extrusion ring 88 to move towards inner surface 16 of outer tubular 12 and intermediate inner anti-extrusion ring 86 to move towards outer diameter surface 18 of the inner tubular 14. Movement of the anti-extrusion rings 86, 88 may be limited either by inner surface 16 of outer tubular 12 and outer diameter surface 18 of the inner tubular 14 respectively, or by the closed ends of energizers 62, 64 contacting upper and lower surfaces of lateral portions 102, 104 of anti-extrusion rings 86, 88.

The downward force on primary anti-extrusion rings 90, 91 will additionally cause downward facing surface 94 of outside primary anti-extrusion ring 90 engages and slide along upward facing surface 96 of inner primary anti-extrusion ring 91. This will result in inner primary anti-extrusion ring 90 to moving towards and coming into contact with outer diameter surface 18 of the inner tubular 14 and outer primary anti-extrusion ring 91 moving towards and coming into contact with inner surface 16 of outer tubular 12. Primary anti-extrusion rings 90, 91 will together then cover the full diameter of annulus 20, limiting the upward expansion of primary seal rings 78, 80. A retaining mechanism, such as retaining ring 108 will be used to maintain the downward force on primary anti-extrusion rings.

Seal assembly 21 may be installed within annulus 20 with a interference between the inner surface 16 of outer tubular 12 and outer diameter surface 18 of the inner tubular 14. The compression on the energizers 62, 64 causes legs 68, 70 of primary energizer 62 and legs 74, 76 of backside energizer 64 to deflect inwardly, generating an outward radial elastic load. This will cause seal rings 80, 84 to be compressed between inner surface 16 of outer tubular 12 and the energizers 62, 64 respectively, and seal rings 78, 82 to be compressed between outer diameter surface 18 of the inner tubular 14 and energizers 62, 64, respectively. The compressive forces causes plastic deformation of seal rings 78, 80, 82, 84, causing them to deform and become thinner and taller. The increase in height of seal rings 78, 80 is contained to the space between the primary anti-extrusion rings 90, 91 and the intermediate anti-extrusion rings 86, 88. The increase in height of seal rings 82, 84 is contained to the space between the intermediate anti-extrusion rings 86, 88 and the backside anti-extrusion rings 92, 93. The combination of the elastic deformation of energizers 62, 64 and plastic deformation of seal rings 78, 80, 82, 84 creates a constant elastic contact pressure at each of the sealing interfaces which does not diminish with time or load history or temperature, and creates a seal at low pressure and also possibly at high pressure.

Alternatively, the radial outward elastic load of energizers 62, 64 may be created by the fluid pressure within grooves 66, 72, which applies an outward force on legs 68, 70, 74, 76, casing outward radial deflections of legs 68, 70, 74, 76. In the same manner as discussed above, this will cause seal rings 78, 80, 82, 84 to be compressed between inner surface 16 of outer tubular 12 and the energizers 62, 64, and the outer diameter surface 18 of the inner tubular 14 and energizers 62, 64, respectively. The compressive forces causes plastic deformation of seal rings 78, 80, 82, 84, causing them to deform and become thinner and taller. The increase in height of seal rings 78, 80 is contained to the space between the primary anti-extrusion rings 90, 91 and the intermediate anti-extrusion rings 86, 88. The increase in height of seal rings 82, 84 is contained to the space between the intermediate anti-extrusion rings 86, 88 and the backside anti-extrusion rings 92, 93. The combination of the elastic deformation of energizers 62, 64 and plastic deformation of seal rings 78, 80, 82, 84 creates a constant elastic contact pressure at each of the sealing interfaces.

Seal rings 78, 80, 82, 84 are formed of soft inelastic materials and may be for example, a soft metal such as lead, tin, silver, gold or tantalum, an inelastic thermoplastic, such as virgin polytetrafluoroethylene, filled polytetrafluoroethylene or polyetheretherketone, or other inert inelastic materials such as compression molded graphite. Seal rings 78, 80, 82, 84 may alternatively be formed of other soft inelastic materials. An appropriate soft inelastic material will be selected so that seal rings 78, 80, 82, 84 will flow readily into defects on the inner surface 16 of outer tubular 12 and the outer diameter surface 18 of the inner tubular 14 and create sufficient contact pressure on the surface of any such defect to create a seal when subjected to radial loading. Where there is no defect present the seal rings 78, 80, 82, 84 will simply deform and flow upwards and downwards to fill the available space, while creating a seal on the defect free inner surface 16 of outer tubular 12 and the outer diameter surface 18 of the inner tubular 14.

Energizers 62, 64 are formed from material, such as steel or nickel or alloy thereof, that is strong enough to withstand the internal fluid pressure within the annulus 20 as well as any internal loads generated by the interference fit between the energizers 62, 64, the inner surface 16 of outer tubular 12 and outer diameter surface 18 of the inner tubular 14, without undergoing significant plastic deformation, which could limit the load that could be applied to energizers 62, 64 or cause failure of energizer 62, 64 and thus cause the seal assembly 21 to fail. Energizers 62, 64 must therefore be made from material with higher strength or that is harder than the material used to make the seal rings 78, 80, 82, 84.

In the drawings and specification, there have been disclosed a typical preferred embodiment of the disclosure, and although specific terms are employed, the terms are used in a descriptive sense only and not for purposes of limitation. The terms "vertical", "horizontal", "upward", "downward", "above", and "below" and similar spatial relation terminology are used herein only for convenience because elements of the current disclosure may be installed in various positions. Embodiments of this disclosure have been described in considerable detail with specific reference to these illustrated embodiments. It will be apparent, however, that various modifications and changes can be made within the spirit and scope of the disclosure as described in the foregoing specification. For example, although primarily illustrated in the context of a casing hanger landed within a modified high-pressure wellhead housing, one of ordinary skill in the art will recognize that the featured seal assembly and methods can be readily employed with respect to tubing within modified casing or other tubing.

What is claimed is:

1. A seal assembly for sealing an annulus between inner and outer wellhead members, the seal assembly comprising:

a U-shaped energizer ring formed of a high strength elastic metal material having inner and outer legs joined by a base at a lower end of the energizer ring, the energizer ring having a central axis;

an annular inner recess formed on an inward facing surface of the inner leg;

an inner diameter seal ring formed of an inelastic metal material, the inner diameter seal ring having an interior surface mounted to the inner recess;

an annular outer recess formed on an outward facing surface of the outer leg;

an outer diameter seal ring formed of an inelastic metal material, the outer diameter seal ring having an interior surface mounted to the outer recess; wherein prior to insertion into the annulus, each of the seal rings has a radial width between the interior surface and an exterior surface of each of the seal rings that is less than an axial dimension from an upper edge to a lower edge of each of the seat rings;

each of the inner and outer legs has a lower base end that joins the base and an upper free end;

each of the inner and outer legs has an interior surface that faces towards the other leg and an exterior surface that faces away from the other leg;

the exterior surface of one of the inner and outer legs has a base portion that extends axially upward from proximate the base end, and a transition portion that extends axially downward from a location axially below a lower end of one of the seal rings to the base portion, the base portion being a cylindrical surface concentric with the axis and the transition portion being a conical surface; and wherein, when the energizer ring is coaxially inserted in the annulus, the free ends of the inner and outer legs elastically deflect toward each other, causing the inner diameter seal ring to be compressively and permanently deformed into sealing contact with the inner wellhead member, and causing the outer diameter seal ring to be compressively and permanently deformed into sealing contact with the outer wellhead member.

2. The seal assembly of claim 1, wherein:

each of the inner and outer legs has an enlarged portion proximate to the free end with a radial width greater than the radial width of the leg proximate to the base end; and the inner recess and the outer recess are formed in the enlarged portions.

3. The seal assembly of claim 1, wherein one leg is a longer leg and the other leg is a shorter leg such that the longer leg has an axial length that is greater than an axial length of the shorter leg.

4. The seal assembly of claim 1, wherein:

each of the inner and outer legs has an enlarged portion proximate to the free end with a radial width greater than the radial width of the leg proximate to the base end; and the exterior surface of at least one leg tapers gradually to the enlarged portion.

5. The seal assembly of claim 1, wherein:

the exterior surface of each of the seal rings is cylindrical prior to insertion of the seal assembly into the annulus.

6. The seal assembly of claim 1, wherein:

the exterior surface of at least one leg has a large radius of curvature extending from the free end towards the recess.

7. The seal assembly of claim 1, wherein:

a largest radial width of at least one of the legs proximate the free end is less than an axial distance between the free end and the recess of the at least one of the legs.

8. The seal assembly of claim 1, wherein the inner diameter seal ring and the outer diameter seal ring are formed of material selected from a group consisting of lead, tin, or silver.

9. The seal assembly of claim 1, wherein:

the inner recess has grooves on a base of the inner recess;

the inner diameter seal ring engages the grooves of the inner recess and protrudes radially outward past the exterior surface of the inner leg;

the outer recess has grooves on a base of the outer recess; and the outer diameter seal ring engages the grooves of the outer recess and protrudes radially outward past the exterior surface of the outer leg.

10. The seal assembly of claim 1, wherein the interior surface of each of the inner and outer legs has a first portion that extends axially upward from proximate the base end to a location axially below a lower end of the seal ring, and a second portion that extends axially downward from proximate the free end to the first portion, the first portion being a cylindrical surface parallel to the axis and the second portion being a conical surface.

11. A wellhead assembly comprising:

an outer wellhead member having a bore and an axis, the outer wellhead member further having a tapered outer wellhead shoulder defined by a change in inner diameter of the outer wellhead member from a region with a smaller inner diameter to a region with a larger inner diameter;

an inner wellhead member located in the bore and defining an annulus between the inner and outer wellhead members, the inner wellhead member further having a tapered inner wellhead shoulder defined by a change in outer diameter of the inner wellhead member from a region with a smaller inner diameter to a region with a larger inner diameter;

a U-shaped energizer ring formed of an elastic metal material and comprising a base, and inner and outer legs joined by and extending axially from the base to a free end that bias in opposing radial directions respectively against the inner and outer wellhead members;

the inner leg having a base end and a free end, and an inward facing surface with an annular inner band located on and protruding inward from the inward facing surface of the inner leg proximate the free end;

an annular inner recess formed in the inner band;

an annular inner diameter seal ring formed of an inelastic metal material located in the inner recess;

the outer leg having a base end and a free end, and an outward facing surface with an annular outer band located on and protruding outward from the outward facing surface of the outer leg proximate the free end;

an annular outer recess formed in the outer band;

an annular outer diameter seal ring formed of an inelastic metal material located in the outer recess;

an open slot between the legs; wherein when the energizer ring is coaxially inserted in the annulus, the free ends of the inner and outer legs elastically deflect toward each other, causing the inner diameter seal ring to be compressively and permanently deformed into sealing contact with the inner wellhead member, and causing the outer diameter seal ring to be compressively and permanently deformed into sealing contact with the outer wellhead member; and wherein the energizer ring is located within the annulus axially between the outer wellhead shoulder and the inner wellhead shoulder.

12. The wellhead assembly of claim 11, wherein an axial length of the band on the inner leg and on the outer leg have a cylindrical end surface concentric with the axis.

13. The wellhead assembly of claim 11, wherein the inner leg has an axial length that is shorter than an axial length of the outer leg.

14. The wellhead assembly of claim 11, wherein the inward facing surface of the inner leg tapers gradually to the inner band.

15. The wellhead assembly of claim 11, wherein the outward facing surface of the outer leg has an undercut recess at a junction of the outward facing surface and the outer band.

16. The wellhead assembly of claim 11, wherein an outer surface of the outer band has a large radius of curvature extending from the free end towards the recess.

17. The wellhead assembly of claim 11, wherein an outer surface of both the outer band and the inner band has a large radius of curvature extending from the free end towards the recess.

18. The wellhead assembly of claim 11, wherein:

the inner recess has grooves on a base of the inner recess;

the inner diameter seal ring engages the grooves of the inner recess and protrudes radially outward past the exterior surface of the inner band;

the outer recess has grooves on a base of the outer recess; and the outer diameter seal ring engages the grooves of the outer recess and protrudes radially outward past the exterior surface of the outer band.

19. The wellhead assembly of claim 11, wherein the inner wellhead shoulder is an upward facing shoulder located axially above the energizer ring and the outer wellhead shoulder is a downward facing shoulder located axially below the energizer ring.

20. A method for sealing an annulus between inner and outer wellhead members, the method comprising the steps of:

(a) providing a seal assembly that comprises a U-shaped energizer ring formed of a high strength elastic metal material having:

a central axis;

inner and outer legs joined by a base at a lower end of the energizer ing and and an upper free end;

an annular inner recess formed on an inward facing surface of the inner leg, and an inner diameter seal ring formed of an inelastic metal material mounted to the inner recess;

an annular outer recess formed on an outward facing surface of the outer leg, and an outer diameter seal ring formed of an inelastic metal material mounted to the outer recess, (b) inserting the seal assembly into the annulus so that the free ends of the inner and outer legs elastically deflect toward each other, causing the seal rings contact inner and outer surfaces of the annulus, plastically deforming the seal rings into sealing engagement between the legs and the inner and outer surfaces by a spring force in the legs; and (c) landing the energizer ring within the annulus axially between a tapered outer wellhead shoulder and tapered inner wellhead shoulder, the outer wellhead shoulder defined by a change in inner diameter of the outer wellhead member from a region with a smaller inner diameter to a region with a larger diameter, and the inner wellhead shoulder being defined by a change in outer diameter of the inner wellhead member from a region with a smaller inner diameter to a region with a larger inner diameter.

21. The method of claim 20, wherein each of the inner and outer legs has an enlarged portion proximate to the free end with a radial width greater than the radial width of the leg proximate to the base end, the exterior surface of one leg tapering gradually to the enlarged portion and the exterior surface of the other leg having a large radius of curvature extending from a free end of the leg towards the recess, wherein the step of inserting the seal assembly into the annulus includes:

slidingly engaging the gradual taper with a surface of one of the wellhead members; and slidingly engaging the large radius of curvature with the other of the wellhead members.

22. The method of claim 20, wherein the exterior surface of both the inner and outer legs having a large radius of curvature extending from a free end of the leg towards the recess, wherein the step of inserting the seal assembly into the annulus includes:

slidingly engaging the large radius of curvature of the outer leg with the outer wellhead member; and slidingly engaging the large radius of curvature of the inner leg with the inner wellhead member.

23. The method of claim 18, wherein the inner wellhead shoulder is an upward facing shoulder located axially above the energizer ring and the outer wellhead shoulder is a downward facing shoulder located axially below the energizer ring, wherein step (b) further comprises engaging at least one of the upward facing shoulder and the downward facing shoulder with a portion of the energizer ring to apply the spring force in the legs.

* * * * *